US007382693B2

(12) United States Patent
Charpier

(10) Patent No.: US 7,382,693 B2
(45) Date of Patent: Jun. 3, 2008

(54) DATE INDICATOR MECHANISM FOR WATCH MOVEMENT

(75) Inventor: Jean-Pierre Charpier, Morteau (FR)

(73) Assignee: Zenith International S.A., Le Locle (CH)

( * ) Notice: Subject to any disclaimer, the term of this patent is extended or adjusted under 35 U.S.C. 154(b) by 420 days.

(21) Appl. No.: 10/533,610

(22) PCT Filed: Oct. 23, 2003

(86) PCT No.: PCT/CH03/00688

§ 371 (c)(1),
(2), (4) Date: Apr. 29, 2005

(87) PCT Pub. No.: WO2004/040382

PCT Pub. Date: May 13, 2004

(65) Prior Publication Data

US 2006/0034157 A1 Feb. 16, 2006

(30) Foreign Application Priority Data

Oct. 30, 2002 (EP) ..... 02405928

(51) Int. Cl.
*G04B 19/24* (2006.01)

(52) U.S. Cl. ..... 368/37; 368/28

(58) Field of Classification Search ..... 368/37, 368/28, 35–36, 38

See application file for complete search history.

(56) References Cited

U.S. PATENT DOCUMENTS 3,449,905 A * 6/1969 Besson ..... 368/35
3,451,211 A * 6/1969 Nakagawa ..... 368/38
3,703,805 A * 11/1972 Ganter et al. ..... 368/34
3,911,667 A * 10/1975 Komiyama ..... 368/38
6,711,098 B2 * 3/2004 Berard ..... 368/28
6,744,696 B2 * 6/2004 Vernay et al. ..... 368/37

FOREIGN PATENT DOCUMENTS

CH 322341 * 6/1957
CH 322 341 A 7/1957
CH 346 170 A 6/1960

OTHER PUBLICATIONS

English Translation of CH 322 341.
English Translation of CH 346 170.

* cited by examiner

*Primary Examiner*—P. Austin Bradley
*Assistant Examiner*—Sean Kayes
(74) *Attorney, Agent, or Firm*—Townsend M. Belser, Jr.; Nexsen Pruet, LLC

(57) ABSTRACT

The invention relates to an instantaneous mechanism for controlling the date indicator (24) of a timepiece movement. It comprises: a 24-hour wheel (10) pierced with a first cutout (12*b*), a date driving wheel (16) mounted to rotate freely on the 24-hour wheel (10), coaxial therewith and having a pin (18) which fits into the cutout and a tooth (20) which collaborates with the indicator (24) to cause it to move on step by step each day at around midnight, and a spring balance (26, 32) collaborating with the pin (18). These components are shaped, sized and arranged in such a way that, at around midnight, the balance (26) escapes from the pin (18) and returns abruptly to its rest position, throwing forward the pin (18) and the driving wheel (16) whose tooth (20) strikes the date indicator (24) to cause it to move on by one step.

13 Claims, 2 Drawing Sheets

DATE INDICATOR MECHANISM FOR WATCH MOVEMENT

The present invention relates to timepieces with a date display. It relates more specifically to an instantaneous date indicator mechanism for a watch movement.

It can be recalled that such a mechanism allows the instantaneous change in date to take place at midnight. Each evening, the energy of a spring, armed over several hours by a 24-hour wheel, is abruptly released to cause the dial-style or needle-style date indicator to move on by one step.

Although the date indicator is positioned by a jumper, it may happen that the strike that it receives at midnight causes it to jump twice and this, quite clearly, greatly diminishes the benefit of an instantaneous mechanism.

It is therefore absolutely essential, for a quality watch, that the mechanism be entirely free of the risk of the date indicator jumping twice. In addition, this mechanism has not only to allow the date to be corrected quickly but must also, and this goes without saying, be of the most reliable, robust and inexpensive construction possible.

It is precisely the object of the present invention to provide an instantaneous date mechanism that meets the above-stated requirement.

More specifically, the invention relates to an instantaneous mechanism for controlling the date indicator of a timepiece movement, characterized in that it comprises:

- a 24-hour wheel driven by the movement at the rate of one revolution per day and pierced with a first cutout,
- a date driving wheel mounted to rotate freely on the 24-hour wheel, coaxial therewith, said wheel having a pin which fits into the cutout and a tooth which collaborates with the indicator to cause it to move on step by step each day at around midnight, and
- a spring balance collaborating with the pin.

According to the invention, these components are shaped, sized and arranged in such a way as to perform the following cycle of operations:

- a few hours before midnight, the pin begins to act on the balance, then in its rest position, thereby arming its spring;
- at around midnight, the balance escapes from the pin and returns abruptly to its rest position, throwing forward the pin and the driving wheel whose tooth strikes the date indicator to cause it to move on by one step; and
- a few hours after midnight, the pin is once again caught by the cutout in the 24-hour wheel and pushed until, a few hours before midnight, it comes back into contact with the balance.

According to a particularly advantageous embodiment, the first cutout is in the shape of an arc of a circle concentric with the 24-hour wheel. This cutout is also the continuation of a second cutout releasing a spring finger and opens onto the end of this finger.

Figure 4:
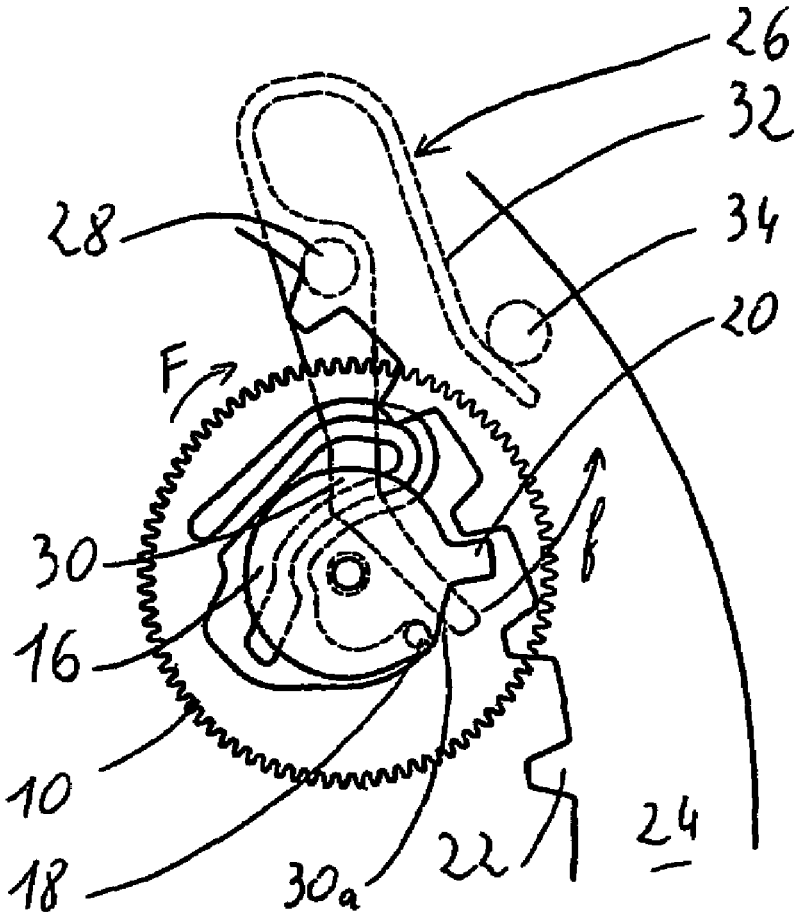
Figure 5:
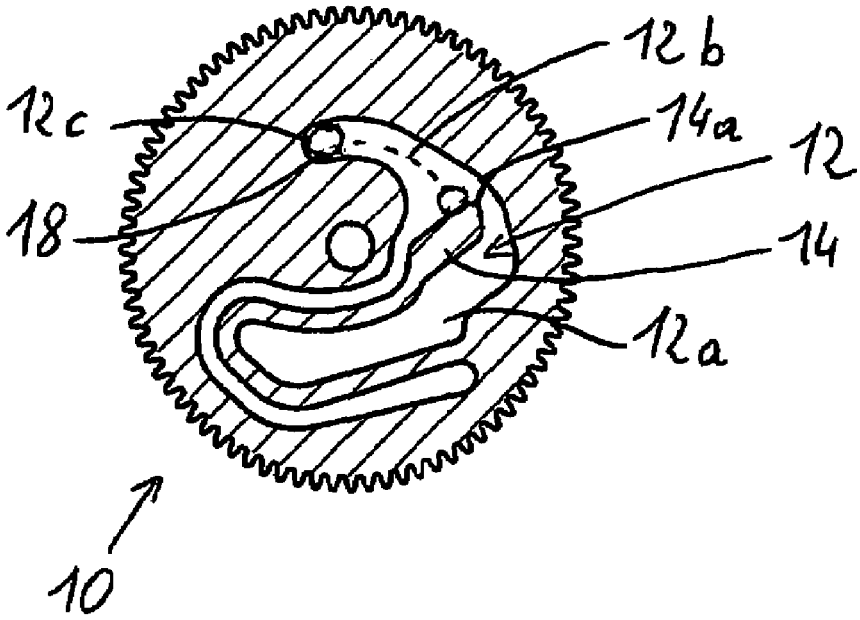

Other features of the invention will emerge from the description which follows, given with reference to the attached drawing, in which:

FIGS. 1, 2, 3 and 4 depict the mechanism in the positions it occupies at 20:00 H, just before the jump at midnight, just after the jump at midnight, and at 06:00 H respectively; and FIG. 5 is a view of the 24-hour wheel of the mechanism.

In the conventional way, the mechanism according to the invention is mounted on a mounting plate which also acts as a base for the components of the watch movement. The mounting plate is not depicted in the drawing because this type of construction is well known to those skilled in the art.

In the figures, 10 depicts a 24-hour wheel driven in the clockwise direction (arrow F) at the rate of one revolution per day, off the movement's hours wheel. As best shown in FIG. 5, this wheel is pierced with a cutout 12 in two communication portions. The portion 12*a* serves to release a hairpin-shaped spring finger 14, while the portion 12*b* continues the portion 12*a* from the end 14*a* of the finger 14 and forms an arc of a circle concentric with the wheel 10. Its end bears the reference 12*c*. In the example depicted, the angular separation between the end 12*c* of the cutout and the end 14*a* of the finger is of the order of 90°.

A second wheel 16, known as the date driving wheel, is mounted, free to rotate, on the 24-hour wheel 10, coaxial therewith. This wheel, at its periphery, bears a pin 18 sized to fit and move in the portion 12*b* of the cutout 12. It also has, at the rear of the pin 18, an external tooth 20, shaped to collaborate with the thirty-one teeth 22 of a date annulus 24. In the example depicted, the angular separation between the pin 18 and the tooth 20 is of the order of 45°.

The mechanism according to the invention also comprises a balance 26 in the form of a lever mounted to pivot about an arbor 28 and having an elbow 30 which typically forms an angle of about 135° and against the upstream flank 30*a* of which the pin 18 of the wheel 16 presses and slides in such a way as to cause the balance to pivot in the counter-clockwise direction (arrow f). The lever 26 is extended, beyond its arbor 28, by a spring 32 bent into a hairpin shape and the end of which rests against a peg 34.

The downstream flank 30*b* of the elbow is, by contrast, used to drive the pin forwards, as will be described more fully hereinbelow.

Finally, the mechanism comprises, in the conventional way, a jumper and its spring (neither depicted) for positioning the date annulus 24.

The way the mechanism according to the invention works will now be described with reference to FIGS. 1, 2, 3 and 4 in succession.

Figure 1:
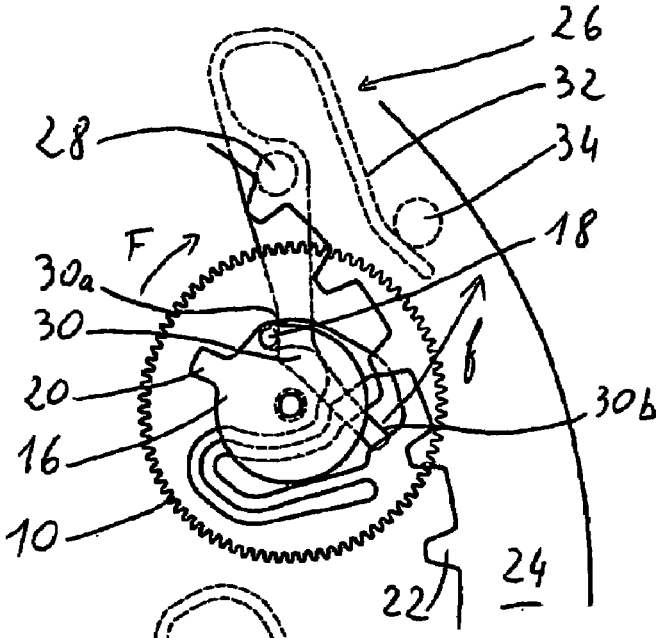

At around about 20:00 H, as depicted in FIG. 1, the pin 18, driven by the end 12*c* of the cutout in the wheel 10, comes into contact with the upstream flank 30*a* of the elbow 30, which it begins to push. The lever 26, which was in its rest position, therefore starts to pivot in the direction f, thereby arming the spring 32, while the pin slides along the flank 30*a* toward the vertex of the elbow.

Figure 2:
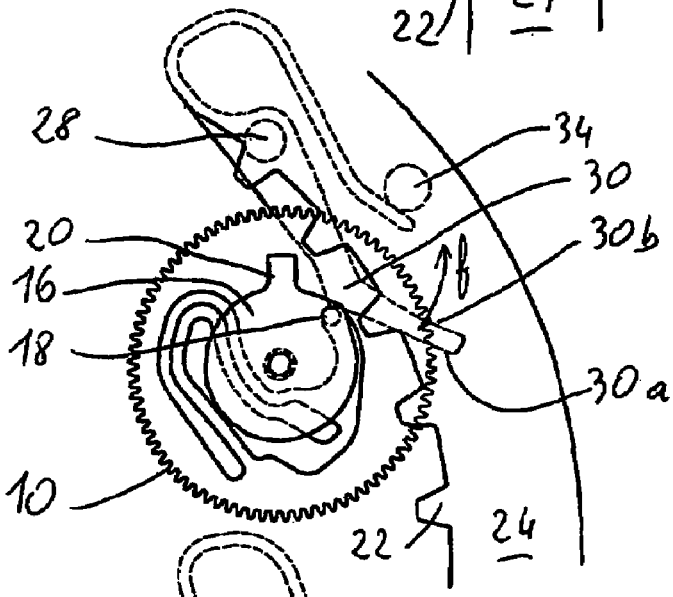
Figure 3:
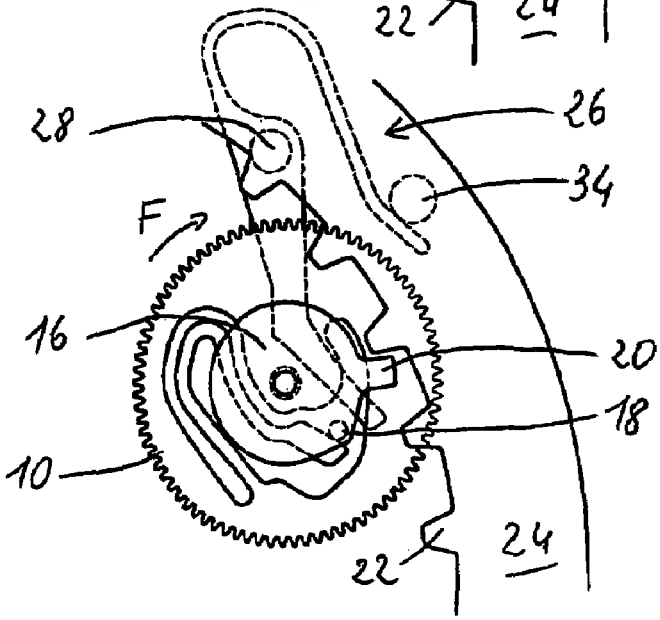

At midnight, as shown by FIG. 2, the pin 18 moves over onto the downstream flank 30*b* of the elbow. It is then the lever 26 which takes over and, under the effect of its spring 32, which is fully armed, drops back abruptly into its rest position, illustrated in FIG. 3. The downstream flank 30*b* thus throws forward the pin 18 and the driving wheel 16 whose tooth 20 strikes a tooth 22 of the date annulus 24 and therefore causes the latter to move on by one step.

It is important to point out that the pin 18 butts against the end 14*a* of the spring finger 14, thus preventing the tooth 20 of the wheel 16 from, under its impetus, causing the date annulus 24 to jump a second time.

Finally, at around 06:00 H, as illustrated by FIG. 4, the pin 18—which has not moved since midnight because it was no longer driven by the wheel 10—is once again caught by the end 12*c* of the cutout 12. It will thus be driven, with its wheel 16 until, at around 20:00 H, it butts against the upstream flank 30*a* of the elbow 30 to find itself back in the configuration of FIG. 1.

A new cycle, identical to the one that has just been described, then begins.

Throughout the day there is nothing to prevent the date from being corrected quickly, in the conventional way, by direct action on the teeth 22 of the annulus 24. What happens is that the rotation of the wheel 16, driven by the teeth 22, is not prevented because, as soon as the pin 18 butts against the end 14*a* of the spring finger 14, the latter retracts.

An instantaneous date indicator mechanism that is fully protected against the risk of a double jump and allows the date to be corrected quickly is thus proposed. It will also be noted that this mechanism essentially consists of just three components: a cutout 24-hour wheel, a driving wheel and a balance. These are parts which are both simple to produce, and therefore inexpensive, and able to make the operation of the mechanism very reliable.

The invention claimed is:

1. An instantaneous mechanism for controlling the date indicator of a timepiece movement, comprising:

a 24-hour wheel driven by the movement at the rate of one revolution per day and pierced with a first cutout, a date driving wheel mounted to rotate freely on the 24-hour wheel, coaxial therewith, said wheel having a pin which fits into said first cutout and a tooth which collaborates with said indicator to cause it to move on step by step each day at around midnight, and a spring balance collaborating with the pin, these components being shaped, sized and arranged in such a way as to perform the following cycle of operations:

a few hours before midnight, the pin begins to act on the balance, then in its rest position, thereby arming its spring, at around midnight, the balance escapes from the pin and returns abruptly to its rest position, throwing forward the pin and the driving wheel whose tooth strikes the date indicator to cause it to move on by one step, and a few hours after midnight, the pin is once again caught by the first cutout in the 24-hour wheel and pushed until, a few hours before midnight, it comes back into contact with the balance, wherein said first cutout is the continuation, in the shape of an arc of a circle concentric with the 24-hour wheel, of a second cutout releasing a spring finger, the first cutout opening onto the end of the spring finger.

2. The mechanism as claimed in claim 1, wherein said spring finger is in the shape of a hairpin.

3. The mechanism as claimed in claim 2, wherein the angular separation between the pin and the tooth of the driving wheel is of the order of 45°.

4. The mechanism as claimed in claim 2, wherein the spring balance comprises a lever mounted to pivot on an arbor and having an elbow against the upstream flank of which the pin presses and slides in such a way as to cause said lever to pivot and the downstream flank of which is used, by contrast, to propel said pin forward.

5. The mechanism as claimed in claim 1, wherein the angular separation between the end of the first cutout and the end of the spring finger is of the order of 90°.

6. The mechanism as claimed in claim 5, wherein the angular separation between the pin and the tooth of the driving wheel is of the order of 45°.

7. The mechanism as claimed in claim 5, wherein the spring balance comprises a lever mounted to pivot on an arbor and having an elbow against the upstream flank of which the pin presses and slides in such a way as to cause said lever to pivot and the downstream flank of which is used, by contrast, to propel said pin forward.

8. The mechanism as claimed in claim 1, wherein the angular separation between the pin and the tooth of the driving wheel is of the order of 45°.

9. The mechanism as claimed in claim 8, wherein the spring balance comprises a lever mounted to pivot on an arbor and having an elbow against the upstream flank of which the pin presses and slides in such a way as to cause said lever to pivot and the downstream flank of which is used, by contrast, to propel said pin forward.

10. The mechanism as claimed in claim 1, wherein the spring balance comprises a lever mounted to pivot on an arbor and having an elbow against the upstream flank of which the pin presses and slides in such a way as to cause said lever to pivot and the downstream flank of which is used, by contrast, to propel said pin forward.

11. The mechanism as claimed in claim 10, wherein the elbow of the lever makes an angle of about 135°.

12. The mechanism as claimed in claim 10, wherein the lever is extended, beyond its arbor, by a spring, the end of which rests against a peg.

13. The mechanism as claimed in claim 12, wherein the elbow of the lever makes an angle of about 135°.

* * * * *